United States Patent [19]

Evans

[11] Patent Number: 4,949,784

[45] Date of Patent: Aug. 21, 1990

[54] WELLHEAD LEAK CONTAINMENT

[75] Inventor: Vlanton R. Evans, Crane, Tex.

[73] Assignee: Atlantic Richfield Company, Los Angeles, Calif.

[21] Appl. No.: 450,987

[22] Filed: Dec. 15, 1989

[51] Int. Cl.[5] ..... E21B 33/08

[52] U.S. Cl. ..... 166/81; 166/95; 166/165

[58] Field of Search ..... 166/81, 75.1, 85, 86, 166/88, 92, 93, 94, 95, 97, 50, 162, 165, 169, 243, 902

[56] References Cited

U.S. PATENT DOCUMENTS

| | | | |
|---|---|---|---|
| 2,884,067 | 4/1959 | Marken | 166/75.1 |
| 3,270,810 | 9/1966 | Johnston | 166/81 |
| 3,353,606 | 11/1967 | Dyer | 166/88 |
| 4,665,976 | 5/1987 | Retherford | 166/81 |

*Primary Examiner*—Stephen J. Novosad

*Assistant Examiner*—Terry Lee Melius

*Attorney, Agent, or Firm*—Roderick W. MacDonald

[57] ABSTRACT

An apparatus for producing fluid from a wellbore using a reciprocating pump which moves a sucker-rod string through the wellhead of the wellbore, a catch basin is carried by the wellhead in the vicinity where the sucker-rod string exits from the wellhead, the basin being located so that liquid leaking from the wellhead flows down the wellhead and into the basin, sump means spaced from the wellhead and a first conduit means in open communication between the basin and the sump means for draining fugitive liquid from the wellhead into the sump means, and second conduit means carrying first valve means and being in communication between the wellhead and the sump means so that a visual inspection of the liquid passing through the wellhead can be achieved by opening first valve means and viewing the nature and character of the liquid that flows from the wellhead into the sump means.

14 Claims, 2 Drawing Sheets

WELLHEAD LEAK CONTAINMENT

BACKGROUND OF THE INVENTION

Heretofore wellbores have been drilled into the earth's surface to penetrate one or more geologic formations containing a liquid mineral such as crude oil for recovery at the earth's surface. When the pressure in the producing geologic formation is not sufficient to force the liquid mineral to the earth's surface, artificial lifting, i.e., pumping, is employed to move the liquid from the producing formation or formations through the wellbore to the earth's surface for recovery, transportation, processing, and the like.

One form of artificial lift widely employed in the oil patch is a reciprocating pumping unit sometimes referred to as a pump jack which is connected by a string of sucker rods to a pump that is disposed downhole in the wellbore in the vicinity of the geologic formation from which the desirable liquid is to be pumped. The pumping unit is a complete set of surface equipment necessary to impart up-and-down (reciprocating) motion to the sucker-rod string and the downhole pump. This equipment includes a prime mover or power plant connected by way of a pitman to a walking beam at one end of which is a horsehead. The sucker-rod string is connected to the horsehead and as the horsehead reciprocates up and down it moves the sucker-rod string and the downhole pump with it.

Wellbores are completed at the earth's surface with a wellhead which closes off the one or more casing and tubing strings that are disposed in the wellbore. The sucker-rod string passes through the wellhead and exits from the wellhead at the top thereof through a device known as a stuffing box. The stuffing box contains a packing for keeping produced liquid from leaking out around the sucker rod as it exits the wellhead and thereafter running down the outside of the wellhead to the earth's surface to contaminate same. Liquid produced from the wellbore into the wellhead is transferred by way of a conduit means connected between a tee in the wellhead and a tank battery for storage, treatment, and subsequent transportation.

Speed reduction between the power plant and the pitman is accomplished by combination of V-belt drive and/or gear reducer means well known in the art so that with an engine speed of, for example, 600 revolutions per minute, a speed reduction ratio of 30 to 1 can be accomplished to cause the unit to operate at 20 strokes per minute. With one end of the pitman connected to the speed reduction means and the other end to the walking beam, the rotational motion generated by the power plant is translated into the reciprocating motion of the walking beam, horsehead, sucker-rod string and downhole pump. The power plant may be either an internal combustion engine or electric motor or the like. A set of weights attached to the walking beam counterbalances the weight of the sucker rods and part of the weight of the liquid being pumped, and helps the power plant lift the sucker rods and liquid on the upstroke.

This type of pumping system needs a means for packing or sealing off the pressure inside the wellbore where the sucker-rod string exits from the wellhead to prevent leakage of liquid and gas from inside the wellhead at that point. Stuffing boxes consist of flexible material or packing housed in a box which provides a means for compressing the packing around a sucker rod section, often times a polished rod. The stuffing-box packing is replaced by a field hand when it becomes worn and loses its seal thereby allowing small amounts of liquid and/or gas to leak out of the wellhead before the packing is replaced.

This invention is directed to catching liquid and/or gas leaking from the wellhead, particularly the stuffing box, to prevent such fluids from contaminating the earth around the wellhead and collecting such leaking fluids in a manner so that they can be returned to the wellbore by way of the wellhead and/or disposed of in other manners such as in a nearby tank battery, portable collection tank, or the like.

BRIEF SUMMARY OF THE INVENTION

Accordingly, this invention, in one broad embodiment, relates to apparatus for producing liquid from a wellbore capped by a wellhead through which extends a sucker-rod string wherein the improvement comprises a catch basin carried by the wellhead in the vicinity where the sucker rods exit from the wellhead, the catch basin being located so that liquid leaking from the wellhead flows down the outside of the wellhead and into the catch basin, a sump means spaced from the wellhead and adapted to hold liquid of the type produced from the wellbore, first conduit means in open communication between the catch basin and the sump, and second conduit means carrying first valve means, the second conduit means being in communication between the well head and the sump so that, upon opening of the first valve means, liquid from the wellbore being produced through the wellhead can be flowed through the second conduit means directly into the sump for visual inspection of the nature and condition of the liquid being produced through the wellhead at that point in time.

Accordingly, is an object of this invention to provide a new and improved apparatus for the production of liquid from a wellbore. It is another object to provide a new and improved apparatus for preventing the contamination of the earth surrounding the wellhead of a producing wellbore, particularly one being produced with a reciprocating surface pumping unit. It is another object to provide a new and improved apparatus for checking the nature and condition of liquid flowing through a wellhead without contaminating the earth in the vicinity of the wellhead.

Other aspects, objects, and advantages of this invention will be apparent to those skilled in the art from this disclosure and the appended claims.

DETAILED DESCRIPTION OF THE INVENTION

Figure 1:
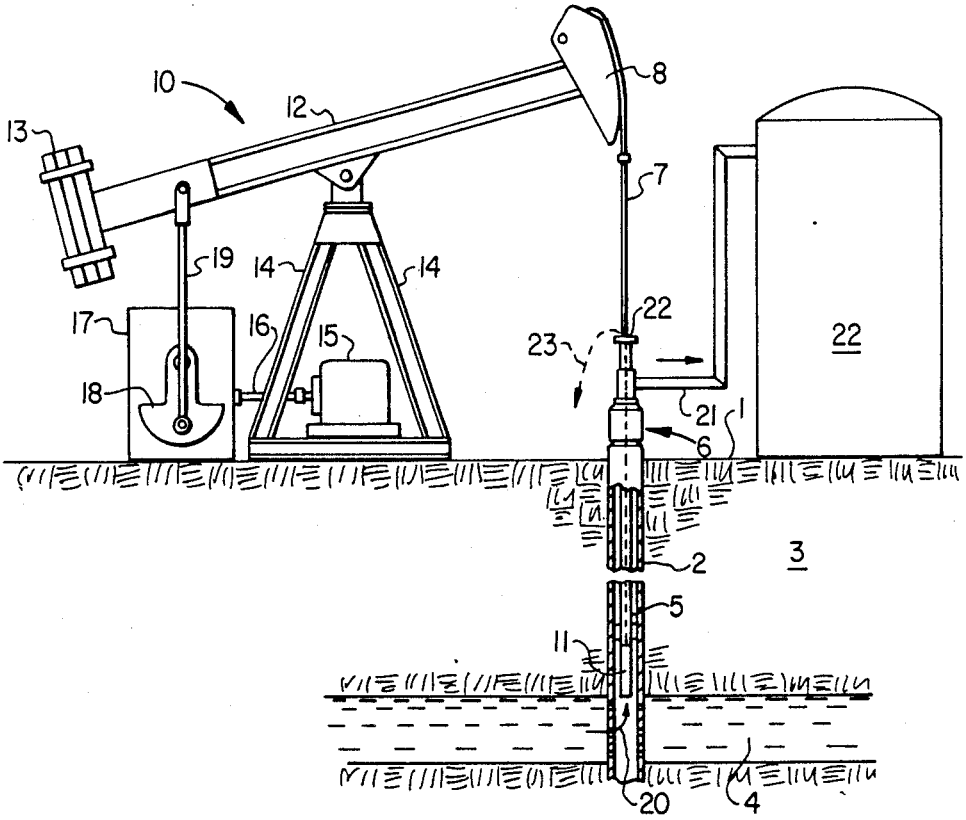
FIG. 1 shows a cross section of a wellbore in the earth topped by a wellhead which is connected to a reciprocating surface pumping unit and a tank battery for storing liquid produced from the wellbore.

More specifically, FIG. 1 shows the earth's surface 1 having a wellbore 2 drilled into the earth 3 until it penetrates a subsurface geologic formation 4 from which desirable fluids can be produced to earth's surface 1. Wellbore 2 can be lined with steel casing or unlined, as desired, and contains production tubing 5 and conventional packoff therein. Wellbore 2, any casing therein, and production tubing 5 are capped at earth's surface 1 by wellhead 6. Wellhead 6 has a string of sucker rods 7 passing therethrough which string is connected at its upper end to horsehead 8 of surface pumping unit 10 and at its lower end to downhole reciprocating pump 11.

Horsehead 8 is fixed to one end of walking beam 12 while counterweights 13 are fixed to the opposite end of walking beam 12. Walking beam 12 is supported by support means 14 which are known as samson posts. The prime mover or power plant 15 is connected by a suitable drive means 16 to gear reducer 17 which carries and rotates crank and counter weights 18. Pitman 19 is connected to crank 18 and to walking beam 12 so that the rotational speed of power plant 15 is reduced in gear reducer 17 and translated by way of pitman 19 into the reciprocating up and down motion of horsehead 18. This in turn reciprocates the downhole pump up and down in production tubing 5 thereby produces liquid shown by arrow 20 from geologic reservoir 4 through perforations in the casing, if any, into tubing 5, through pump 11, and up the wellbore to wellhead 6.

Liquid such as crude oil thus produced into wellhead 6 is transferred by way of conduit means 21 into tank battery 22 for storage. The top surface 22 of wellhead 6 where sucker-rod string 7 reciprocates in and out of the wellhead is the position where a conventional stuffing box is employed to seal off the pressure inside wellhead 6 and tubing 5 to prevent leakage of liquid down the outside of wellhead 6 to the surface of the earth around that wellhead as shown by dotted line 23.

Figure 2:
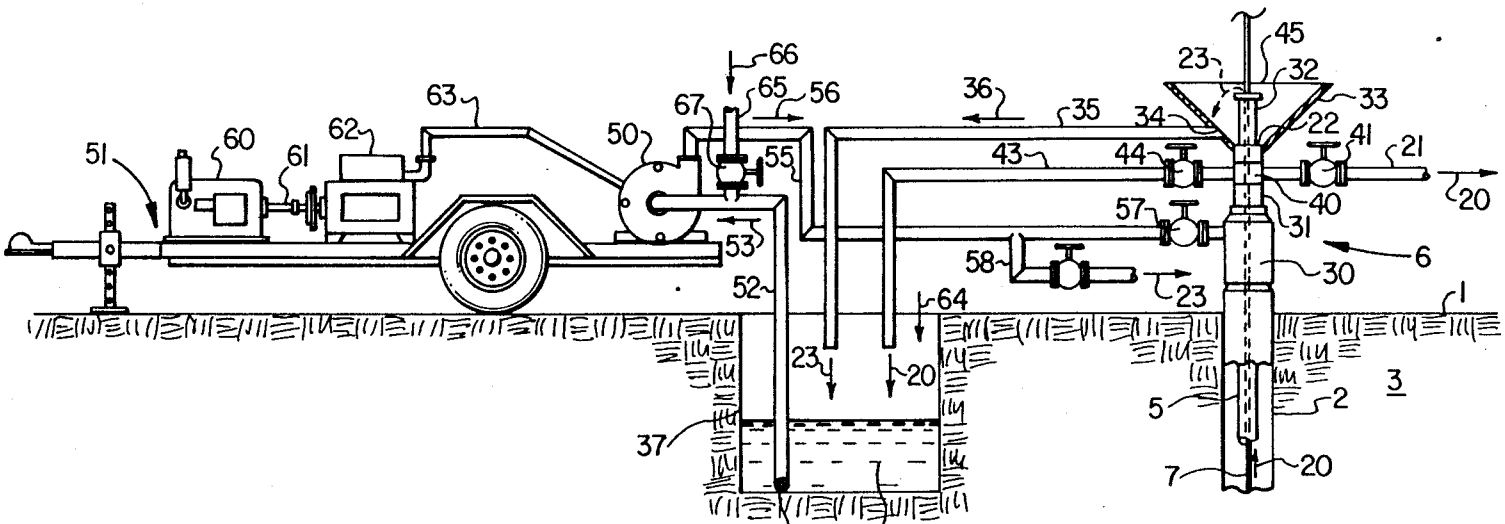
FIG. 2 shows a top portion of the wellbore in FIG. 1 connected to a sump means and a transportable pumping unit for use in this invention.

FIG. 2 shows wellhead 2 to be composed of a larger diameter lower portion 30 surmounted by a smaller diameter upper portion 31 which is capped at upper surface 22 with a conventional stuffing box 32. Surrounding wellhead portion 31 in the vicinity of upper surface 22 and stuffing box 32 is disposed catch basin 33 which is located so that leaking liquid 23 from stuffing box 32 flows down the wellhead into catch basin 33, is trapped in catch basin 33, and is prevented from flowing on down wellhead 6 to earth's surface 1. Trapped liquid 23 then passes through aperture 34 in a lower portion of catch basin 33 into first conduit means 35 to pass, as shown by arrow 36, into sump means 37.

Sump 37 is shown to be a below-earth's-surface-1 installation, but sump 37 can be employed on top of surface if desired. Sump 37 is made of a material suitable for storing liquid 23, for example, fiberglass when liquid 23 is crude oil. Sump 37 should be located in relation to wellhead 30 so that a well servicing unit such as a pulling unit or wire line unit has good access to wellhead 30 without concern for driving into conduit means 35 or sump 37. Sump 37 can have an open top covered with an expanded steel grating or the like, or can be completely closed if desired with an observation port therein so that at all times an observer from earth's surface 1 can see what liquid is already in sump 37 and what liquid is being delivered to sump 37 by way of conduit means 35.

A conventional tee fitting is employed in wellhead portion 31 at 40 so that conduit 21 can communicate with the interior of wellhead portion 31. This way, liquid flowing through tubing 5 into wellhead 31 can pass out of wellhead 31 into conduit 21 and then to storage tank battery 22. Conduit 21 has a valve means 41 therein for restricting or stopping the flow of liquid from wellhead 6 to tank battery 22.

Similarly, second conduit means 43 carrying first valve means 44 is in communication with wellhead 6 so that upon opening first valve means 44 at least a portion of liquid 20 flowing through wellhead 6 can be bled off or diverted from entering conduit means 21 for alternate passage into sump 37. An operator can then partially open first valve means 44 and allow at least a portion of liquid 20 to run into sump 37. This way the nature and condition of liquid 20 which is at that time passing through wellhead 6 can be observed by the operator while standing on the earth's surface. Thus, a sample of liquid 20 can be bled off from wellhead 6 without risk of any of that liquid reaching or otherwise contaminating earth's surface 1.

Figure 3:
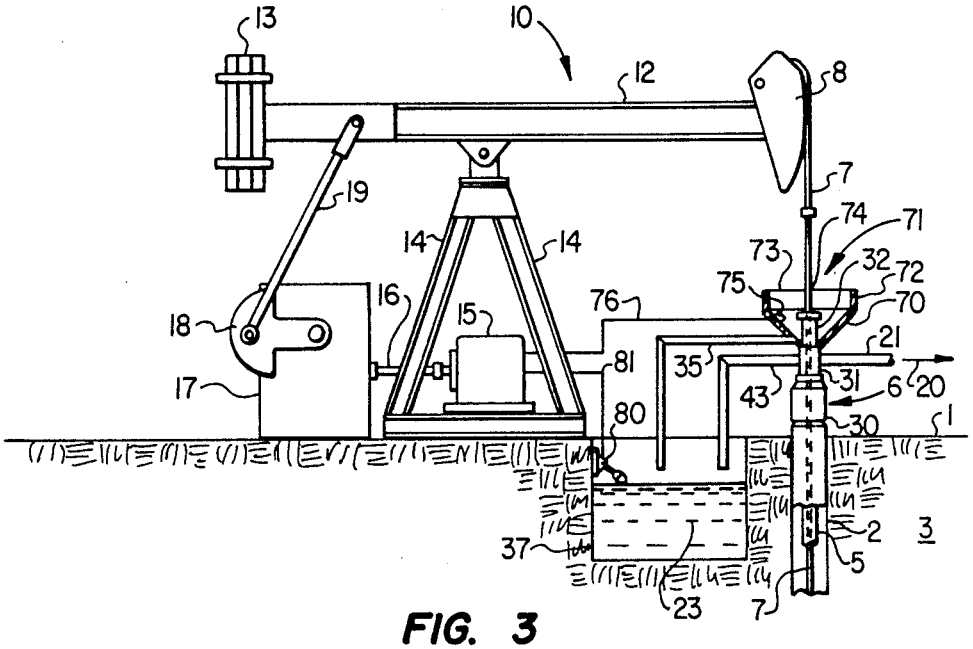
FIG. 3 shows the apparatus of FIGS. 1 and 2 with additional modifications made thereto.

Catch basin 33 in the embodiment of FIG. 2 has an open top 45 but the top can be closed if desired as disclosed in greater detail in FIG. 3. With an open top 5 the nature and condition of leaking liquid 23 can be observed in catch basin 33 from the earth's surface by the operator as well. When the top of catch basin 33 is left open, aperture 34 near the bottom of the catch basin which communicates with conduit means 35 should be made quite large in area with respect to the amount of liquid 23 that is to flow therethrough so that wind-borne material which happens to collect in catch basin 33 and fall to the bottom thereof will not completely stop the flow of liquid 23 from catch basin 33 into conduit means 35.

It can be seen from the foregoing that accidental liquid leaks from the wellhead can be contained and collected in a sump thereby preventing contamination of the ground area around wellhead 6. At the same time a sample of liquid flowing through wellhead 6 can be collected by way of conduit means 43, again without risk of contaminating the ground area around wellhead 6, and further without risk of such contamination by way of accidental opening or leakage of first valve means 44. Since the combination of catch basin 33 and conduit means 35 relies upon gravity drainage, conduit means 35 can be in open communication with catch basin 33 at all times without fear of contamination risk and without the expense of pumps and the like.

Further in accordance with this invention, a surface pump means 50 which can be transportable by being mounted on trailer 51 or permanent by being mounted on earth's surface 1 can be employed to remove liquid 23 from sump 37 by way of third conduit means 52 as shown by arrow 3. The end of third conduit means 52 which is disposed in liquid 23 in sump 37 can carry a conventional filter ball 54 thereon for filtering out debris in sump 37 before it is pulled into conduit means 52. Pump 50 forces liquid thus removed from sump 37 into fourth conduit means 55 which is pumped as shown by arrow 56 through valve 57 back into wellhead 6. This way liquid 23 in sump 37 is returned into wellbore 2. Alternatively, or at the same time, all or a portion of liquid 23 can be passed by way of valved conduit means 58 to tank battery 22. This way, liquid in sump 37 can be returned to the wellbore from which it came and/or transported to surface storage for further treatment, transportation, or the like. Surface sump 50 is preferably a self-priming pump such as a diaphragm pump which can be run on compressed air, natural gas, or the like. It is preferred that such pump employ inert trim on its valves for chemical resistance purposes. For example, gasoline motor 60 mounted on trailer 51 powers by way of line 61 an air compressor 62 which in turn powers by way of line 63 a self-priming diaphragm pump 50 for removal of liquid 23 from sump 37.

When liquid 23 is returned by way of fourth conduit means 55 to wellhead 6 and, therefore, wellbore 2, one or more chemicals can be added to liquid 23 for desired downhole chemical treatment in wellbore 2. For example, chemical can be added to the liquid in sump 37 as shown by arrow 64 in a manual or other known manner. Alternatively, chemical can be added to third conduit means 52 by way of fifth conduit means 65 as shown by arrow 66 when valve 67 is open. This way corrosion inhibiters, paraffin inhibiters, lubricants for downhole pump 11, and the like can easily be injected into wellbore 2 by use of the liquid in sump 37.

This system, can now be seen to have the distinct advantage of keeping all liquids in the production system, i.e. wellhead, tank battery, and sump, thereby keeping earth's surface 1 free of leaks or accidental spills of produced liquid and chemicals injected into wellbore 2 as described above.

FIG. 3 shows drilling unit 10 whose horsehead is connected to sucker-rod string 7 that passes through wellhead 6. Catch basin 70 has a structure similar to that shown for catch basin 33 of FIG. 2 and is also located on wellhead 6 relative to stuffing box 32 as described hereinabove, but is modified to have a top closure means 71. Closure 71 is composed of upstanding sides 72 and a solid top 72 closing what would otherwise be open top 45 of catch basin 33. This way catch basin 70 totally encloses at least a portion of wellhead 6 thereby not only providing for catching fugitive liquid 23 as described in FIG. 2, but also for catching any liquid that may be sprayed due to high pressure inside wellhead 6 into the atmosphere from, for example, around stuffing box 32 and/or fugitive gas produced from a subsurface geologic formation into the wellbore and then into the wellhead. It is preferable that at least part of one or both of sides 72 or top 73 of catch basin 71 be made of a clear material such as plastic so that an operator standing on the earth's surface can visually inspect the fluids, if any, escaping into catch basin 70 without having to open the interior of catch basin 70 to the environment. Alternatively, a small inspection hole with a cover can be used for the same purpose if a clear window is not desired or feasible. At point 74 where sucker-rod string 7 exits from top 73 a seal means can be employed for prevention of the escape of liquid, spray and/or gas from the interior of catch basin 70. This closure means can simply be a felt or other flexible gasket surrounding sucker-rod string 7 or can be a conventional lubricator device for oiling the sucker-rod (polished rod) which continually reciprocates up and down through stuffing box 32 and top closure 73.

When a closed catch basin such as basin 70 is employed, a gas sensor 75 of conventional construction can be fixed in the interior of catch basin 70 and operatively connected by way of line 76 to power plant 15. Sensing means 75 can then be adjusted to detect one or more gases, such as toxic gases like hydrogen sulfide, and then set to shut down power plant 15 should the gas concentration in the interior of catch basin 70 exceed a predetermined maximum limit set into sensor 75. This would protect against continued production when an undesirable gas should suddenly escape from wellhead 6.

Similarly, a liquid level sensor such as a float switch 80 can be fixed inside sump 37 to detect the upper level of liquid 23 in that sump and also to shut down power plant 15 should the level of liquid 23 in sump 37 reach a predetermined maximum point within sump 37. This would prevent overflowing of sump 37 by continued operation of pumping unit 10, thereby also preventing contamination of surface 1 by liquid from sump 37. Yet another modification within the scope of this invention would be to connect a permanent electric pump within the interior of sump 37 which, when the liquid level in sump 37 reaches a point which activates switch 80, instead of shutting down power plant 15 by way of line 81, line 81 could instead connect line 81 to the permanent pump means. This way line 81 would be used, instead of deactivating power plant 15, to activate the pump means in the sump to pump liquid from sump 37 into tank battery 22. Other variations obvious of those skilled in the art once apprised of this disclosure can be made within the scope of this invention.

Figure 4:
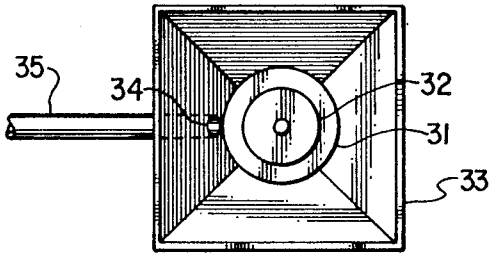
FIG. 4 shows a top view of the wellhead and catch basin of FIG. 2.

FIG. 4 shows a top view of catch basin 33 and shows that basin to be of a square cross section. Any configuration of cross section, i.e., round, square, rectangular, and the like, can be employed within this invention.

EXAMPLE

Equipment essentially as shown in FIG. 2 has been employed on a producing oil well. This equipment was composed of a catch basin as shown in FIGS. 2 and 4 made from quarter inch steel and employing a two inch diameter aperture 34 which carried a pipe collar welded thereto and to which was threaded two inch plastic pipe for conduit 35. Tank battery tee 40 carried a one inch diameter steel nipple and valve means 44 and one inch plastic pipe was used between the steel nipple and sump 37 for conduit 43.

Sump 37 was a seventy-gallon, fiberglass, buried, open top tank covered with an expanded steel grating. A gasoline motor 60 was used to power an air compressor/volume tank combination 62 and the compressed air was used to power diaphragm pump 50.

This combination of apparatus was employed to pull crude oil from sump 37 by way of conduit 52 and pump same into wellhead portion 30 by way of conduit 55. Surfactant was added to the crude oil in sump 37 and pumped into wellhead portion 30 and then into wellbore 2 by operation of pump 50 not only to return crude oil to the wellbore, but also to slug the wellbore with surfactant to clean the wellbore and/or downhole pump 11 as well as to lubricate downhole pump 11 for a more optimum overall pumping process.

Reasonable variations and modifications are possible within the scope of this disclosure without departing from the spirit and scope of this invention.

What is claimed is:

1. In apparatus for producing fluid from a wellbore in the earth wherein said wellbore is capped at the surface of the earth with a wellhead, said wellhead being adapted for use with a reciprocating downhole rod pump which is carried by a sucker-rod string that extends from said downhole pump through said wellhead and connects with a reciprocating pumping unit on the earth's surface, said pumping unit being operated by a power plant means, the improvement comprising a catch basin carried by said wellhead in the vicinity where said sucker-rod string exits from said wellhead, said basin being located so that liquid leaking from said wellhead flows down said wellhead into said catch basin, a sump means spaced from said wellhead and adapted to hold liquid of the type produced from said wellbore, at least a portion of the interior of said sump means being available for visual inspection from the earth's surface, first conduit means in open communication between a lower portion of said catch basin and said sump means for draining liquid from said catch basin into said sump means, and second conduit means carrying first valve means and being in communication between said wellhead and said sump means, said second conduit means being in communication with that portion of said wellhead through which flows liquid being produced from said wellbore so that upon opening said first valve means at least a portion of said liquid in said wellhead flows from said wellhead through said second conduit means and into said sump means.

2. The apparatus of claim 1 wherein there is employed surface pumping means for removing liquid from the interior of said sump means and third conduit means in communication between said sump means and said surface pumping means, and fourth conduit means in valved communication between said surface pumping means and at least one of said wellhead and a storage tank means.

3. The apparatus of claim 2 wherein said fourth conduit means is in valved communication with said wellhead so that operation of said surface pumping means when said fourth conduit means valve is open removes liquid from said sump means and returns said liquid to said wellbore by way of said wellhead.

4. The apparatus of claim 1 wherein said sump means carries a liquid level sensing means which is operably connected to said power plant means so that when the liquid level in the interior of said sump means reaches a predetermined point said sensing means shuts down said power plant means.

5. The apparatus of claim 1 wherein said catch basin has a top closure means so as to close the interior of said catch basin and to completely contain within the closed interior of said catch basin at least the portion of said wellhead where said sucker rods exit from said wellhead.

6. The apparatus of claim 5 wherein at least a portion of the closed interior of said catch basin is available for visual inspection from the earth's surface.

7. The apparatus of claim 5 wherein gas sensing means is carried in the closed interior of said catch basin and is operably connected to said power plant means so that upon detection of at least one predetermined gas composition in said closed interior, said gas sensing means shuts down said power plant.

8. The apparatus of claim 7 wherein said gas sensing means detects at least one toxic gas.

9. The apparatus of claim 8 wherein said toxic gas is hydrogen sulfide.

10. The apparatus of claim 2 wherein means is employed for adding at least one chemical to the liquid in at least one of said sump means and third conduit means for injection of said chemical into said wellbore by way of said surface pumping means and wellhead.

11. The apparatus of claim 10 wherein said means for adding chemical comprises valved fifth conduit means in communication with at least one of said sump means and said third conduit means.

12. The apparatus of claim 1 wherein the cross sectional area of said first conduit means is substantially oversized in relation to the interior volume of said catch basin so that wind borne debris settling to the bottom of said catch basin will not completely stop the flow of liquid from said catch basin into said first conduit means.

13. The apparatus of claim 1 wherein said wellhead carries a stuffing box where said sucker-rod string exits from said wellhead and said catch basin is fixed to said wellhead below said stuffing box.

14. The apparatus of claim 13 wherein said catch basin is closed and surrounds said stuffing box.

* * * * *